US007819509B2

(12) United States Patent
Mita

(10) Patent No.: US 7,819,509 B2
(45) Date of Patent: Oct. 26, 2010

(54) LIQUID EJECTION HEAD AND MANUFACTURING METHOD THEREOF

(75) Inventor: Tsuyoshi Mita, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 607 days.

(21) Appl. No.: 11/905,115

(22) Filed: Sep. 27, 2007

(65) Prior Publication Data

US 2008/0079785 A1 Apr. 3, 2008

(30) Foreign Application Priority Data

Sep. 29, 2006 (JP) ..... 2006-269592

(51) Int. Cl.
*B41J 2/045* (2006.01)

(52) U.S. Cl. ..... 347/71

(58) Field of Classification Search ..... 347/68, 347/70–72; 29/25.35, 890.1
See application file for complete search history.

(56) References Cited

U.S. PATENT DOCUMENTS 5,530,465 A 6/1996 Hasegawa et al.
6,345,424 B1 2/2002 Hasegawa et al.
6,840,602 B2 * 1/2005 Watanabe et al. ..... 347/71
2002/0196314 A1 12/2002 Greiser et al.

FOREIGN PATENT DOCUMENTS

JP 11-34321 A 2/1999
JP 2001080068 A * 3/2001
JP 2002-370353 A 12/2002
JP 2003-25573 A 1/2003
JP 2003-165214 A 6/2003
JP 2004-351878 A 12/2004

* cited by examiner

*Primary Examiner*—An H Do
(74) *Attorney, Agent, or Firm*—Birch, Stewart, Kolasch & Birch, LLP

(57) ABSTRACT

The liquid ejection head includes: a liquid ejection port; a pressure chamber which has a recess part connected to the liquid ejection port; a lower electrode which is arranged on the pressure chamber; a piezoelectric body which has a planar face arranged on the lower electrode; and an upper electrode which is arranged on the piezoelectric body, wherein: a cross section of the recess part of the pressure chamber taken in parallel to the planar face of the piezoelectric body is oblong and has a breadth CWx in a breadthways direction and a length CWy in a lengthwise direction; the piezoelectric body has an active region having a breadth DWx in the breadthways direction of the cross section of the recess part of the pressure chamber and a length DWy in the lengthwise direction of the cross section of the recess part of the pressure chamber.

5 Claims, 17 Drawing Sheets

FIG.4

| ASPECT RATIO CWy/CWx | GENERATED PRESSURE (MPa) |
|---|---|
| 5 | 0.67 |
| 4 | 0.56 |
| 3 | 0.44 |
| 2 | 0.32 |
| 1 | 0.23 |

LIQUID EJECTION HEAD AND MANUFACTURING METHOD THEREOF

BACKGROUND OF THE INVENTION

1. Field of the Invention

The present invention relates to a liquid ejection head and a manufacturing method thereof, more particularly to a liquid ejection head constituted of at least lower electrodes, piezoelectric bodies and upper electrodes, which are successively arranged over pressure chambers connected to liquid ejection ports, and a manufacturing method thereof.

2. Description of the Related Art

Japanese Patent Application Publication No. 2002-370353 discloses a liquid spray head constituted of an upper electrode having the width Lu in the direction of arrangement of liquid chambers (pressure chambers), a piezoelectric body having the length Lp in the direction of arrangement of the liquid chambers, and a lower electrode having the width L1 in the direction of arrangement of the liquid chambers, in which the relationships between these dimensions are $Lu \leqq Lp < L1$.

Japanese Patent Application Publication No. 2003-025573 discloses a piezoelectric transducer for use in an ink jet print head which the piezoelectric transducer has an outer perimeter sized and positioned to overlap a chamber aperture (a pressure chamber).

Japanese Patent Application Publication No. 2003-165214 discloses an ink ejection head constituted of a pressure chamber having the breadth L in the breadthways direction, and a drive electrode having the width δ in the same direction as the breadth L, in which conditions of 0.1 mm≦L, and $0.29 \leqq (\delta/L) \leqq 1$ or optimum conditions of $0.57 \leqq (\delta/L) \leqq 0.77$, are satisfied.

Japanese Patent Application Publication No. 2004-351878 discloses an inkjet head in which the planar shape of an individual electrode is formed to a substantially similar shape to the planar shape of the opening of a recess part which forms a pressurization chamber (pressure chamber), and the surface area $A_1$ of the individual electrode and the surface area $A_2$ of the opening of the recess part are set in the range of: $A_2 \times 0.6 \leqq A_1 \leqq A_2 \times 0.9$.

Japanese Patent Application Publication No. 11-034321 discloses an inkjet head in which a piezoelectric active region is formed to a smaller size than a corresponding pressurization chamber, in a planar direction parallel to the piezoelectric film, and is disposed in this planar direction at an interval from the perimeter edge of the pressurization chamber, throughout the whole circumference.

There are demands that the aspect ratio of the pressure chambers (when a pressure chamber has the length CWy and the breadth CWx, the aspect ratio of the pressure chamber is CWy/CWx) should be selectable appropriately in accordance with the required characteristics of the liquid ejection head. More specifically, if increased density in the nozzle arrangement in one row is pursued, for example, then it is desirable for the aspect ratio of the pressure chambers to be as high as possible. On the other hand, as the aspect ratio of the pressure chambers increases, the flow channel resistance inside the pressure chambers becomes greater. Hence, when pursuing high-frequency ejection of liquid of high viscosity, it is desirable, conversely, for the aspect ratio of the pressure chambers to be as close as possible to one.

Moreover, a liquid ejection head having high ejection efficiency is also sought. Further, a liquid ejection head which suffers little variation in ejection force between the nozzles is also sought. Furthermore, a liquid ejection head having high reliability, which suffers little variation in ejection volume or other defects over time, is also sought.

As shown in FIG. 14, the lengthwise direction of a pressure chamber 52 coincides with the ink flow direction. If electrodes 91 and 93, which face each other across a piezoelectric body 92, extend to positions in the vicinity of the edges of the pressure chamber 52, then a displacement profile 98 will not be a smooth and efficient displacement profile, a vibration mode having a high harmonic frequency will occur inside the pressure chamber 52, bubbles 99 will become more liable to collect and other adverse effects, such as decline in the ink ejection from the nozzles 51 and generation of residual vibrations, will arise.

SUMMARY OF THE INVENTION

The present invention has been contrived in view of these circumstances, an object thereof being to provide a liquid ejection head and a manufacturing method thereof whereby high ejection efficiency, low ejection fluctuation and high reliability can be achieved simultaneously, in accordance with the selected aspect ratio of the pressure chambers.

In order to attain the aforementioned object, the present invention is directed to a liquid ejection head, comprising: a liquid ejection port; a pressure chamber which has a recess part connected to the liquid ejection port; a lower electrode which is arranged on the pressure chamber; a piezoelectric body which has a planar face arranged on the lower electrode; and an upper electrode which is arranged on the piezoelectric body, wherein: a cross section of the recess part of the pressure chamber taken in parallel to the planar face of the piezoelectric body is oblong and has a breadth CWx in a breadthways direction and a length CWy in a lengthwise direction; the piezoelectric body has an active region positioned between the lower and upper electrodes and contributing to displacement of the piezoelectric body, an area of the active region being smaller than an area of the cross section of the recess part of the pressure chamber, the active region having a breadth DWx in the breadthways direction of the cross section of the recess part of the pressure chamber and a length DWy in the lengthwise direction of the cross section of the recess part of the pressure chamber; a ratio CWy/CWx is in a range of 2 through 5; a ratio DWx/CWx is in a range of 0.4 through 0.75; and a ratio DWy/CWy is in a range of ±0.05 of a central value of $0.133 \times \ln(CWy/CWx) + 0.7312$, where $\ln(CWy/CWx)$ is a natural logarithm of the ratio CWy/CWx.

Here, the aspect ratio CWy/CWx of the pressure chamber can be selected as desired in the range of 2 through 5, in accordance with the required characteristics of the liquid ejection head.

According to the present invention, even if the pressure chamber aspect ratio is set to any desired value in the range of 2 through 5, it is possible to obtain a large displacement volume in the vicinity of the maximum value, and therefore, ejection efficiency is good. Moreover, since variation in the displacement volume as a result of manufacturing variations in the electrode dimensions is extremely small, then the ejection variations between nozzles can be restricted to an extremely low level. Furthermore, the displacement profile is a smooth and highly efficient displacement profile, high harmonic components are not liable to occur in the pressure chamber, bubbles are not liable to form in the pressure chamber, and there are no residual vibrations after liquid ejection. Therefore, reliability is high. Consequently, it is possible to provide the liquid ejection head that simultaneously achieves good ejection efficiency, low ejection variation and high reliability, in accordance with the selected aspect ratio of the pressure chamber.

The cross-sectional shape of the recess part of the pressure chamber may be an oblong rectangular shape, or a non-rectangular parallelogram shape, and may have rounded corners. Even if the pressure chamber has a non-rectangular parallelogram shape and/or rounded corners, provided that the aspect ratio CWy/CWx is not less than 2, then there is no significant change in the displacement volume.

As regards the aspect ratio, in the case of an oblong rectangular shape (which includes a substantially rectangular shape having round corners), the width in the breadthways direction or the breadth means the dimension of the shorter sides of the rectangular, and the width in the lengthwise direction or the length means the dimension of the longer sides of the rectangular; and in the case of a non-rectangular parallelogram shape (which includes a substantially non-rectangular parallelogram shape having round corners), the width in the breadthways direction or the breadth means the shorter of the perpendicular distances between the pairs of opposite sides of the parallelogram (i.e., the shorter height of the parallelogram), and the width in the lengthwise direction or the length means the dimension of the longer sides of the parallelogram.

Preferably, the piezoelectric body has a single sheet structure; and a relationship between a minimum creepage distance Lmin along a surface of the piezoelectric body from an edge of the upper electrode, and a drive electric field E of the piezoelectric body, satisfies $E/Lmin \leqq 1$ (V/μm).

According to this aspect of the present invention, dielectric breakdown caused by creeping discharge is prevented, and the reliability of the liquid ejection head can be improved yet further.

In order to attain the aforementioned object, the present invention is also directed to an image forming apparatus comprising the above-described liquid ejection head.

In order to attain the aforementioned object, the present invention is also directed to a method of manufacturing a liquid ejection head comprising a liquid ejection port, a pressure chamber which has a recess part connected to the liquid ejection port, a lower electrode which is arranged on the pressure chamber, a piezoelectric body which has a planar face arranged on the lower electrode, and an upper electrode which is arranged on the piezoelectric body, the method comprising: forming the recess part of the pressure chamber to have a cross section taken in parallel to the planar face of the piezoelectric body which cross section is oblong and has a breadth CWx in a breadthways direction and a length CWy in a lengthwise direction; and forming the piezoelectric body to have an active region positioned between the lower and upper electrodes and contributing to displacement of the piezoelectric body so that an area of the active region is smaller than an area of the cross section of the recess part of the pressure chamber, the active region has a breadth DWx in the breadthways direction of the cross section of the recess part of the pressure chamber and a length DWy in the lengthwise direction of the cross section of the recess part of the pressure chamber, a ratio CWy/CWx is in a range of 2 through 5, a ratio DWx/CWx is in a range of 0.4 through 0.75, and a ratio DWy/CWy is in a range of ±0.05 of a central value of $0.133 \times \ln(CWy/CWx)+0.7312$, where $\ln(CWy/CWx)$ is a natural logarithm of the ratio CWy/CWx.

Preferably, the piezoelectric body forming step includes forming the piezoelectric body in a thin film by performing at least one of sputtering, aerosol deposition, sol-gel process, screen printing, metal oxide chemical vapor deposition, laser ablation, and hydrothermal synthesis.

According to the present invention, it is possible simultaneously to achieve high ejection efficiency, low ejection variation and high reliability, in accordance with the selected aspect ratio of the pressure chamber.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 4 is a table showing the relationship between the aspect ratio of the pressure chamber and the pressure generated inside the pressure chamber;

DETAILED DESCRIPTION OF THE PREFERRED EMBODIMENTS

Figure 1:
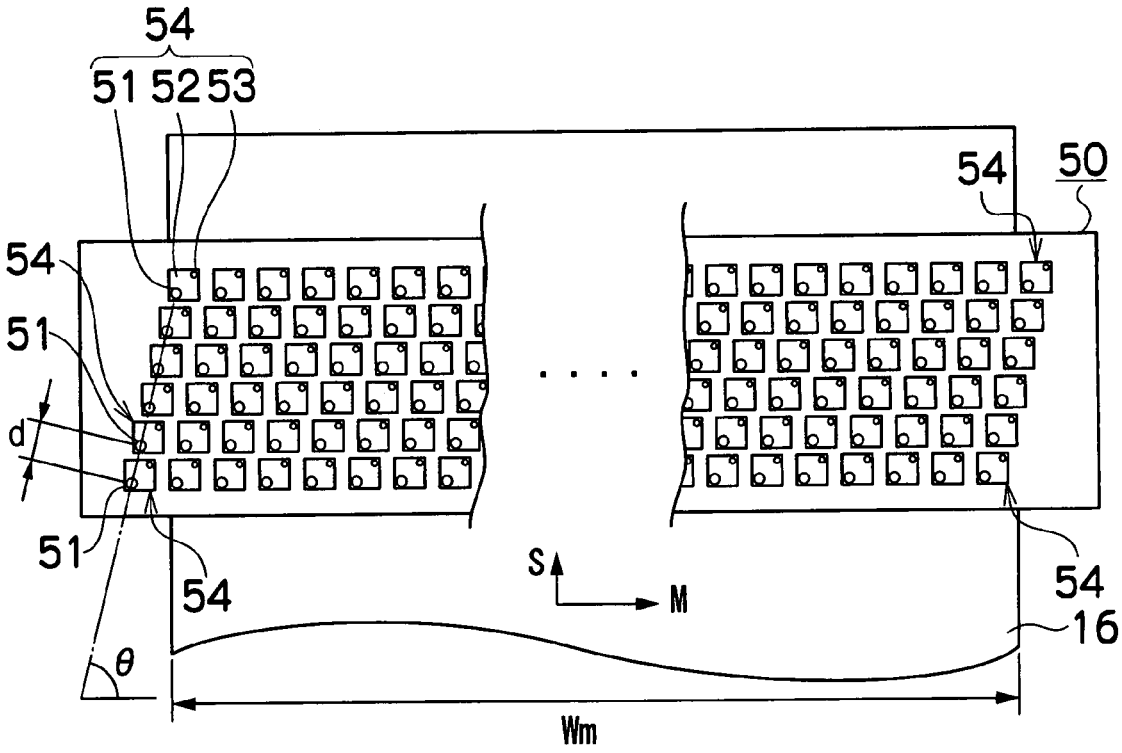
FIG. 1 is a plan view perspective diagram showing the general composition of a liquid ejection head according to an embodiment of the present invention.

FIG. 1 is a plan view perspective diagram showing the general composition of a liquid ejection head 50 according to an embodiment of the present invention.

The liquid ejection head 50 is a so-called full line head, having a structure in which a plurality of nozzles 51, which eject droplets of ink toward a recording medium 16, are arranged in a two-dimensional configuration through a length corresponding to the maximum recordable width Wm of the recording medium 16 in a main scanning direction indicated with an arrow M in FIG. 1 perpendicular to a sub-scanning direction, in which the recording medium 16 is conveyed with respect to the liquid ejection head 50, indicated with an arrow S in FIG. 1.

The liquid ejection head 50 includes a plurality of ejection elements 54, which are arranged in two directions, namely, the main scanning direction M and an oblique direction forming a prescribed acute angle θ (where 0°<θ<90°) with respect to the main scanning direction M. Each of the ejection elements 54 has a nozzle 51, a pressure chamber 52 connected to the nozzle 51, and a liquid supply port 53. In FIG. 1, in order to simplify the drawing, only a portion of the ejection elements 54 are depicted.

More specifically, the nozzles 51 are arranged at a uniform pitch d in the oblique direction forming the acute angle of θ with respect to the main scanning direction M, and hence the nozzle arrangement can be treated as equivalent to a configuration in which nozzles are arranged at an interval of d×cos θ in a single straight line along the main scanning direction M.

In FIG. 1, one example of a full line type of liquid is shown; however, the liquid ejection head according to the present embodiment is not limited in particular to an example of this kind. For example, it is also possible to compose one full line liquid ejection head by combining together a plurality of short head units. Furthermore, for example, it is also possible to adopt a shuttle type (serial type) of liquid ejection head, which is swept over the recording medium 16 in the main scanning direction (a direction perpendicular to the conveyance direction of the recording medium).

Figure 2A:
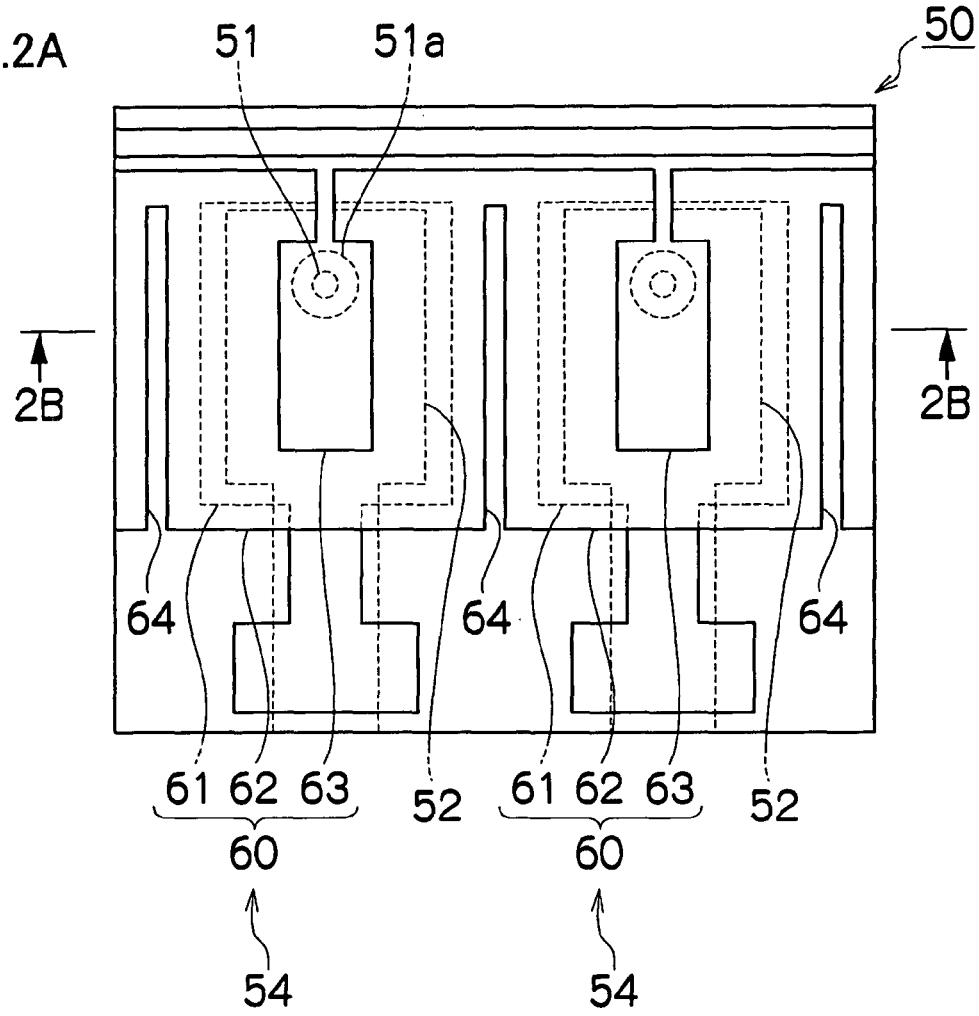
FIG. 2A is a plan diagram showing an enlarged view of a portion of the liquid ejection head in FIG. 1.
Figure 2B:
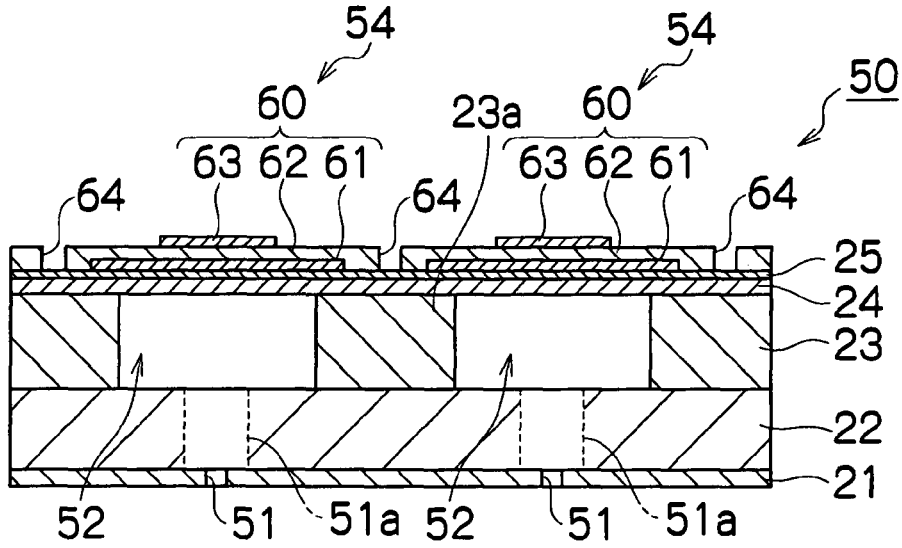
FIG. 2B is a cross-sectional diagram along line 2B-2B in FIG. 2A.

FIG. 2A is a plan view diagram showing an enlarged view of a portion of the liquid ejection head 50 shown in FIG. 1, and FIG. 2B is a cross-sectional diagram along line 2B-2B in FIG. 2A. In FIGS. 2A and 2B, only two ejection elements 54 are depicted, but in actual practice, the plurality of ejection elements 54 are arranged two-dimensionally in the liquid ejection head 50, as shown in FIG. 1.

In FIG. 2B, the liquid ejection head 50 includes: a nozzle plate 21, in which the nozzles 51 are formed; a connection flow channel plate 22, in which nozzle connection flow channels 51*a* connecting to the nozzles 51 are formed; a pressure chamber plate 23, in which the pressure chambers 52 are formed; a diaphragm plate 24, which constitutes the upper wall of the pressure chambers 52; an insulating layer 25; and piezoelectric actuators 60, which serves as devices generating pressure inside the pressure chambers 52. Each of the ejection elements 54 is constituted of the nozzle 51, the pressure chamber 52, the piezoelectric actuator 60, and a liquid supply port (not shown) for supplying liquid to the pressure chamber 52.

The diaphragm 24 is made, for example, of a metal material, such as stainless steel, nickel or chromium, or silicon, zirconia, or a piezoelectric material. The thickness of the diaphragm 24 is, for example, 5 μm.

The insulating layer 25 is made, for example, of an insulating material, such as silica, zirconia, or the like. In the present embodiment, the material of the insulating layer 25 is not limited in particular to silica or zirconia. The thickness of the insulating layer 25 is, for example, 1 μm.

Each of the piezoelectric actuators 60 is constituted of a piezoelectric body 62, a lower electrode 61, and an upper electrode 63.

The piezoelectric body 62 is made of a piezoelectric material, such as lead zirconate titanate (PZT), for example. In the present embodiment, the material of the piezoelectric body 62 is not limited in particular to PZT. The thickness of the piezoelectric body 62 is, for example, 4 μm through 5 μm.

The lower electrode 61 and the upper electrode 63 are made, for example, of a conductive material, such as platinum, iridium, gold, or the like. In the present embodiment, the material of the lower electrode 61 and the upper electrode 63 is not limited in particular to platinum, iridium or gold. The thickness of each of the lower electrode 61 and the upper electrode 63 is, for example, 0.2 μm.

The upper electrode 63 is a common electrode, which serves the plurality of piezoelectric actuators 60 and is grounded. On the other hand, the lower electrode 61 is an individual electrode provided for each of the piezoelectric actuators 60. When a prescribed drive signal is applied independently to the lower electrode 61, in other words, when the prescribed drive voltage is applied independently between the two electrodes 61 and 63 in one of the piezoelectric actuators 60, then the piezoelectric body 62 placed between the two electrodes 61 and 63 is displaced (deformed), the pressure inside the pressure chamber 52 is changed by means of the diaphragm 24, and the liquid is ejected from the nozzle 51.

FIGS. 2A and 2B show, as an example, a groove separation structure in which the piezoelectric bodies 62 are separated between the ejection elements 54 by means of grooves 64. The piezoelectric bodies in the present embodiment are not limited in particular to having the groove separation structure, and it is also possible to adopt a structure in which the piezoelectric bodies are completely separated physically between the ejection elements 54. Furthermore, it is also possible to adopt a physically unseparated structure, in which there are no grooves 64 between the ejection elements 54.

The surface area of the piezoelectric body 62 in each of the ejection elements 54 is greater than the cross-sectional area of the recess part of the pressure chamber 52 (i.e., the cross-sectional area of the opening of the pressure chamber 52 parallel to the diaphragm 24; hereinafter referred also to as the "opening cross-sectional area"). In other words, the piezoelectric body 62 is formed so as to cover the pressure chamber 52 across the diaphragm 24. Hence, fracturing of the diaphragm 24 at the boundaries between the diaphragm 24 and walls 23*a* of the pressure chambers 52 is prevented, thereby improving reliability, as well as reducing the stress applied to the piezoelectric body 62.

Moreover, in each of the ejection elements 54 in the present embodiment, the surface area of the upper electrode 63 is smaller than the cross-sectional area of the recess part of the pressure chamber 52. On the other hand, the surface area of the lower electrode 61 is greater than the cross-sectional area of the recess part of the pressure chamber 52. The lower electrode and the upper electrode in the present embodiment are not limited in particular to a case where the surface area of one of the electrodes is smaller than the cross-sectional area of the recess part of the pressure chamber. It is also possible that both the surface area of the lower electrode 61 and the surface area of the upper electrode 63 are smaller than the cross-sectional area of the recess part of the pressure chamber 52.

Figure 3A:
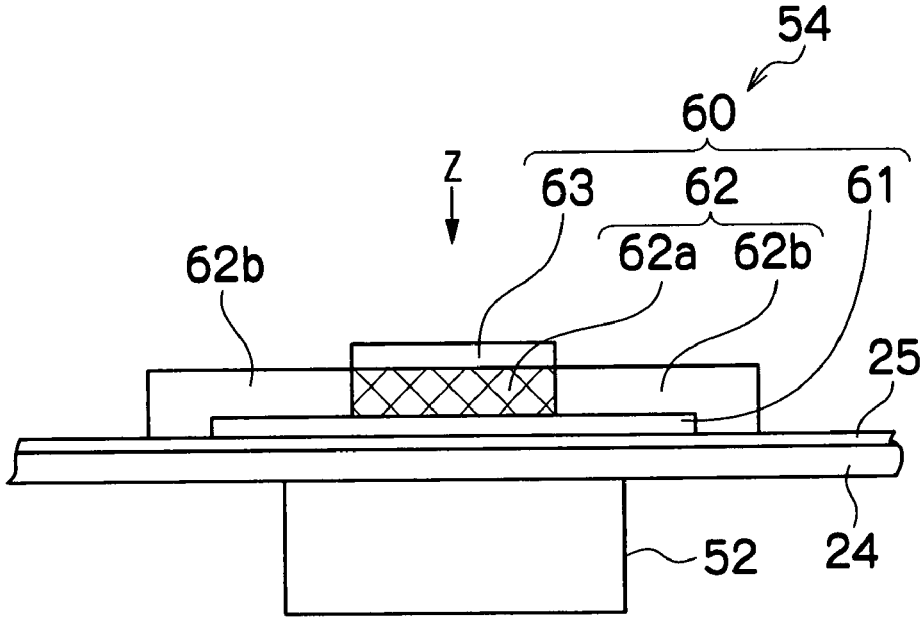
FIG. 3A is an illustrative diagram for describing an active region of a piezoelectric body.

FIG. 3A is a cross-sectional diagram used to describe an active region 62*a* of the piezoelectric body 62. As shown in FIG. 3A, the piezoelectric body 62 is divided into the active region 62*a* (also referred to as a "drive region"), which contributes to the displacement (deformation) of the piezoelectric body 62 when the prescribed drive voltage is applied between the lower electrode 61 and the upper electrode 63, and a non-active region 62*b* (also referred to as a "non-drive region"), which does not contribute to the displacement (deformation) of the piezoelectric body 62 when the drive voltage is applied between the lower electrode 61 and the upper electrode 63. More specifically, when the piezoelectric actuator 60 is viewed from above (in a perpendicular direction with respect to the diaphragm 24) as indicated by an arrow Z in FIG. 3A, the region where the upper electrode 63, the piezoelectric body 62 and the lower electrode 61 are all mutually overlapping forms the active region 62*a*, and the region apart from this forms the non-active region 62*b*.

Figure 3B:
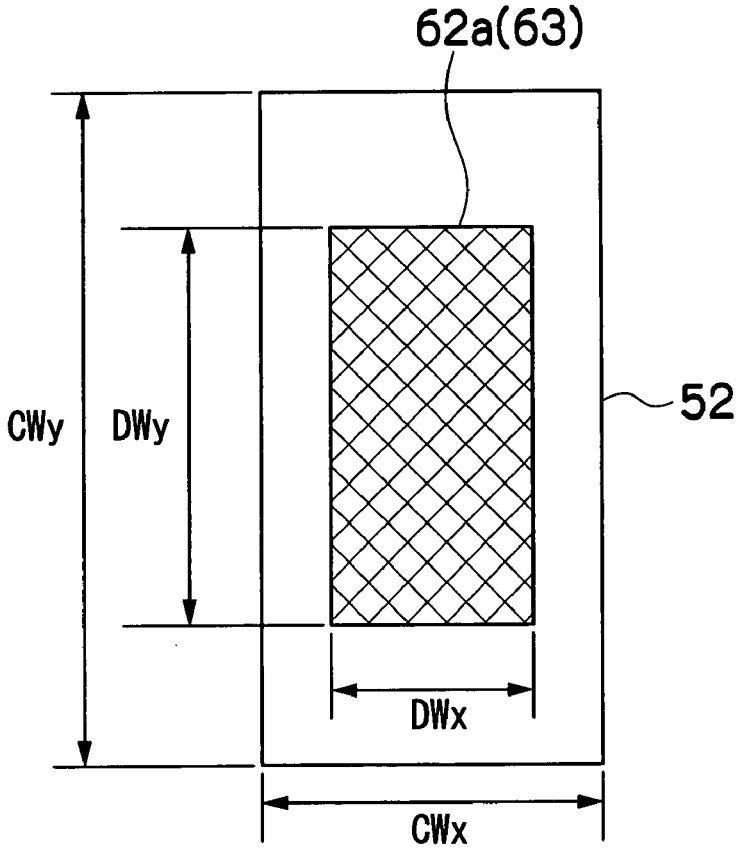
FIG. 3B is an illustrative diagram for describing the breadth CWx and the length CWy of a pressure chamber, and the breadth DWx and the length DWy of the active region.

FIG. 3B shows the pressure chamber 52 and the active region 62*a* of the piezoelectric body 62 in a see-through view in the vertical direction Z in FIG. 3A. The pressure chamber 52 is oblong and has a breadthways direction and a lengthwise direction in the cross-sectional plane of the recess part which plane is parallel to the plane of the plane-shaped piezoelectric body 62 shown in FIG. 3A. In other words, the pressure chamber 52 has the breadthways direction and the lengthwise direction in the cross-sectional plane of the recess part which plane is parallel to the lower electrode 61, the piezoelectric body 62 and the upper electrode 63.

As shown in FIG. 3B, the surface area of the active region 62*a* of the piezoelectric body 62 is smaller than the cross-sectional area of the recess part of the pressure chamber 52. More specifically, in the breadthways direction of the pressure chamber 52 (below, referred to simply as the "breadthways direction"), the width (i.e., breadth) DWx of the active region 62*a* is smaller than the width (i.e., breadth) CWx of the pressure chamber 52, and in the lengthwise direction of the pressure chamber 52 (below, referred to simply as the "lengthwise direction"), the width (i.e., length) DWy of the active region 62*a* is smaller than the width (i.e., length) CWy of the pressure chamber 52.

In the present embodiment, since the upper electrode 63 has the smallest surface area, of the lower electrode 61, the piezoelectric body 62 and the upper electrode 63, then the surface area of the active region 62*a* of the piezoelectric body 62 is equal to the surface area of the upper electrode 63. More specifically, the breadth DWx of the active region 62*a* is equal to the breadth of the upper electrode 63, and the length DWy of the active region 62*a* is equal to the length of the upper electrode 63.

FIG. 4 shows the relationship between the aspect ratio CWy/CWx of the pressure chamber 52 (the ratio between the length CWy and the breadth CWx of the pressure chamber 52) and the pressure generated in the pressure chamber 52.

In FIG. 4, the larger the aspect ratio CWy/CWx of the pressure chamber 52, the greater the pressure generated. The lower the pressure generated, the poorer the suitability for ejecting liquids of high viscosity, and therefore the aspect ratio of the pressure chamber 52 is set to no less than 2. Furthermore, the larger the aspect ratio CWy/CWx of the pressure chamber 52, the better the suitability for high-density arrangement of the nozzles 51. On the other hand, the larger the aspect ratio CWy/CWx of the pressure chamber 52, the greater the flow channel resistance inside the pressure chamber 52, and the worse the suitability for high-frequency ejection. Therefore, the aspect ratio of the pressure chamber 52 is set to no more than 5.

There follows a detailed description of the desirable size of the active region 62*a* of the piezoelectric body 62 in a case where the aspect ratio of the pressure chamber 52 is set to a desired value within the range of 2 through 5.

Figure 5:
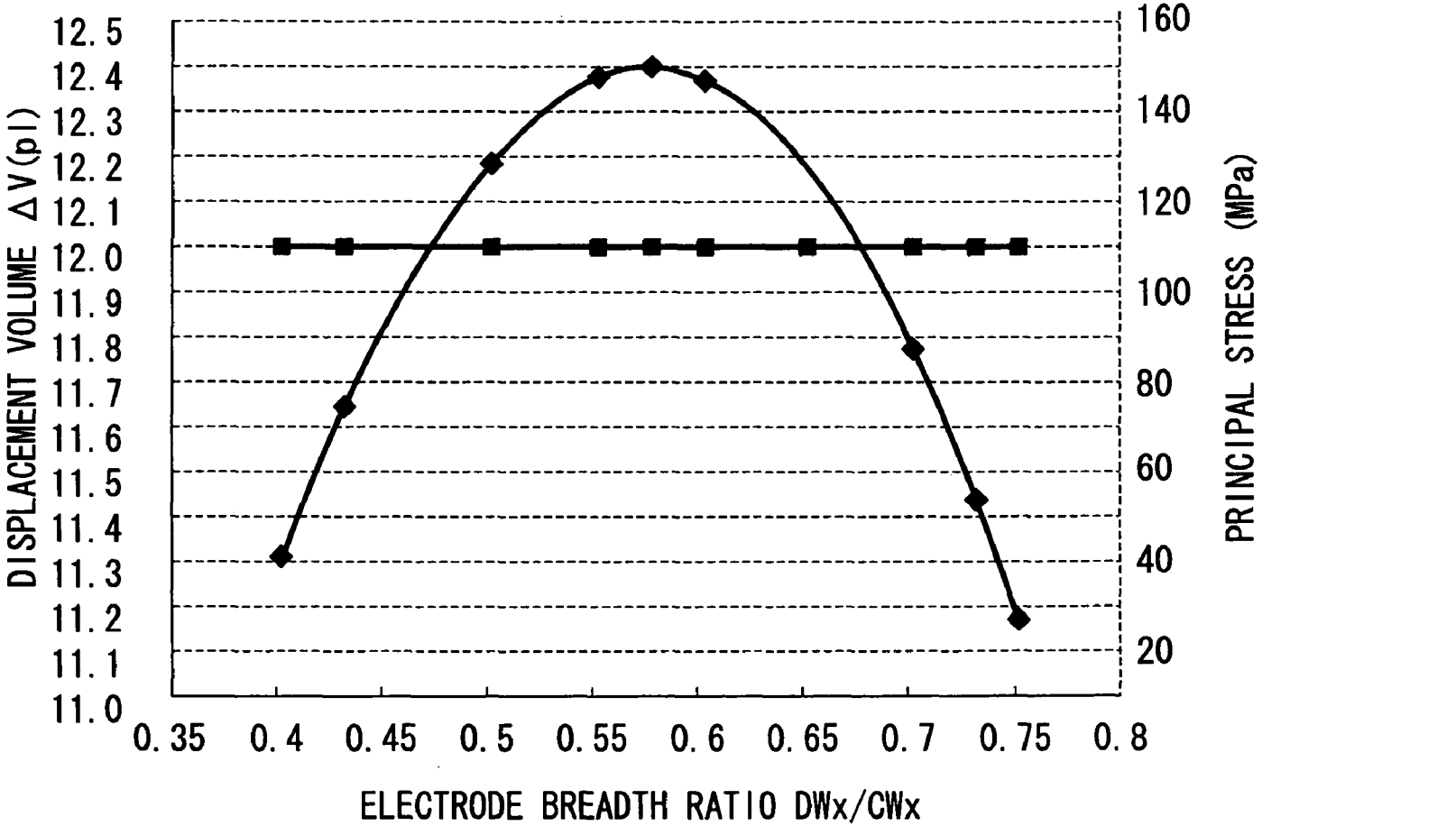
FIG. 5 is a diagram showing the relationship between an electrode breadth ratio and a displacement volume.

FIG. 5 shows the relationship between the breadth DWx of the upper electrode 63 and the displacement volume ΔV and the principal stress, in a case where the aspect ratio CWy/CWx of the pressure chamber 52 is 4.

In FIG. 5, the horizontal axis represents the ratio of the breadth DWx of the upper electrode 63 to the breadth CWx of the pressure chamber 52 (hereinafter referred to as the electrode breadth ratio DWx/CWx). The vertical axis on the left-hand side represents the displacement volume ΔV (unit: (pl)). The vertical axis on the right-hand side represents the principal stress generated in the piezoelectric body 62 (unit: (MPa)).

Figure 6:
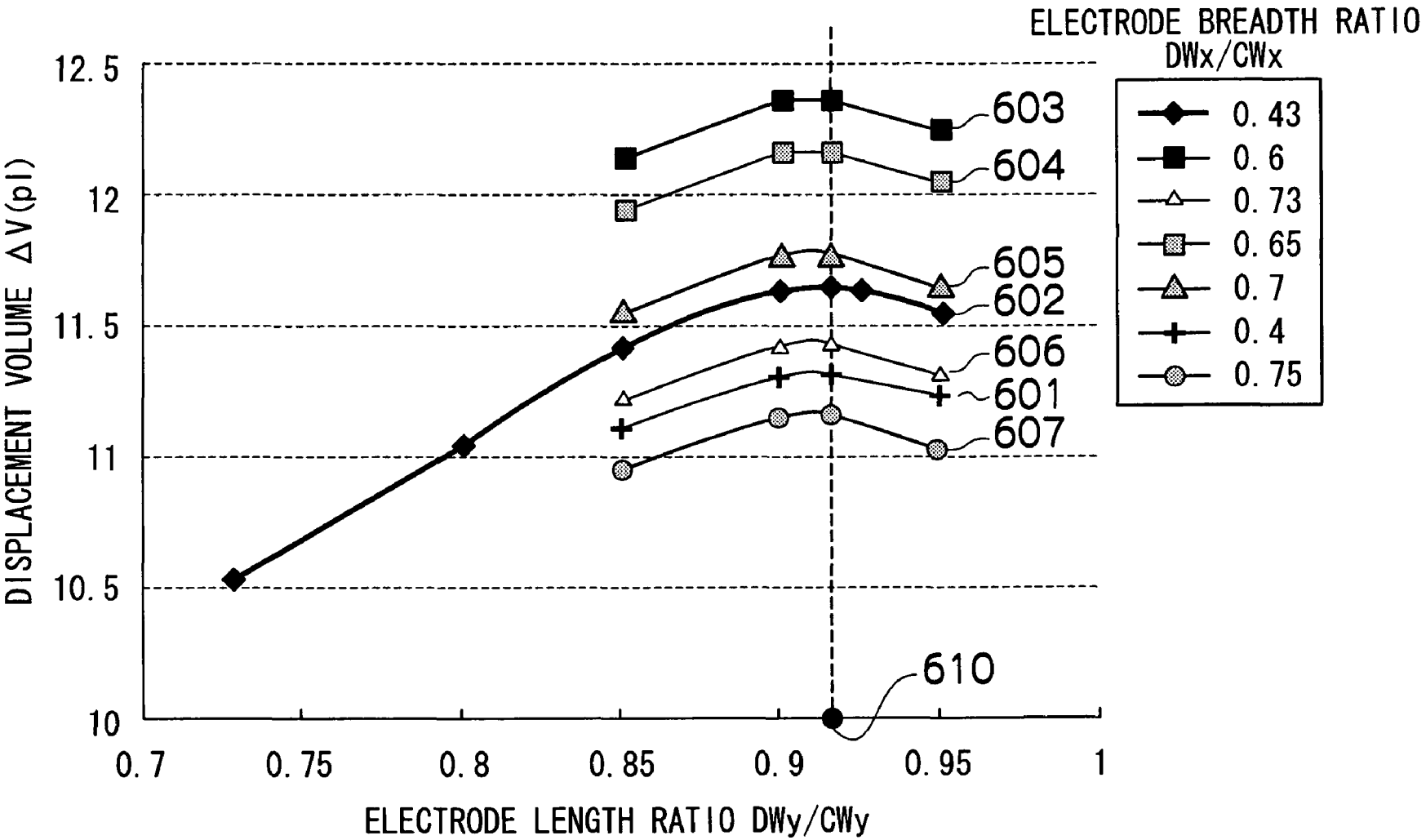
FIG. 6 is a diagram showing the relationship between an electrode length ratio and the displacement volume.

Moreover, FIG. 6 shows the relationship between the length DWy of the upper electrode 63 and the displacement volume ΔV, in a case where the aspect ratio CWy/CWx of the pressure chamber 52 is 4.

In FIG. 6, the horizontal axis represents the ratio of the length DWy of the upper electrode 63 to the length CWy of the pressure chamber 52 (hereinafter referred to as the electrode length ratio DWy/CWy). The vertical axis represents the displacement volume ΔV (unit: (pl)).

Curves 601, 602, 603, 604, 605, 606 and 607 in FIG. 6 are obtained by plotting the displacement volumes ΔV against the electrode length ratios DWy/CWy in the cases where the electrode breadth ratios DWx/CWx are set to 0.4, 0.43, 0.6, 0.65, 0.7, 0.73 and 0.75, respectively.

When the electrode breadth ratio DWx/CWx is 0.6 (represented with the curve 603), the displacement volumes ΔV are greater than when the electrode breadth ratio DWx/CWx takes any of the other values, 0.4, 0.43, 0.65, 0.7, 0.73 and 0.75 (represented with the curves 601, 602, 604, 605, 606 and 607). Furthermore, the electrode breadth ratios DWx/CWx are different in the curves 601 to 607 from each other, while the shapes of the curves 601 to 607 are substantially the same with each other in the vicinity of a central value of the electrode length ratio DWy/CWy (hereinafter referred to as the "optimal value of DWy/CWy") at which a maximum value is obtained for the displacement volume ΔV.

In order to keep the fall of the displacement volume ΔV to within 10% with respect to the maximum value of the displacement volume ΔV (i.e., the maximum value on the curve 603) as the reference value (100%), the electrode breadth ratio DWx/CWx is set within a range of 0.4 through 0.75, and the electrode length ratio DWy/CWy is set within a range of −0.05 through +0.05 with respect to the optimal value of DWy/CWy (approximately 0.91).

With reference to FIGS. 5 and 6, the desirable dimensions for the active region 62*a* of the piezoelectric body 62 (in the present embodiment, the desirable dimensions of the upper electrode 63) have been determined for the case where the aspect ratio CWy/CWx of the pressure chamber 52 is 4. Below, cases are described where the aspect ratio of the pressure chamber 52 is varied within the range of 2 through 5.

Figure 7:
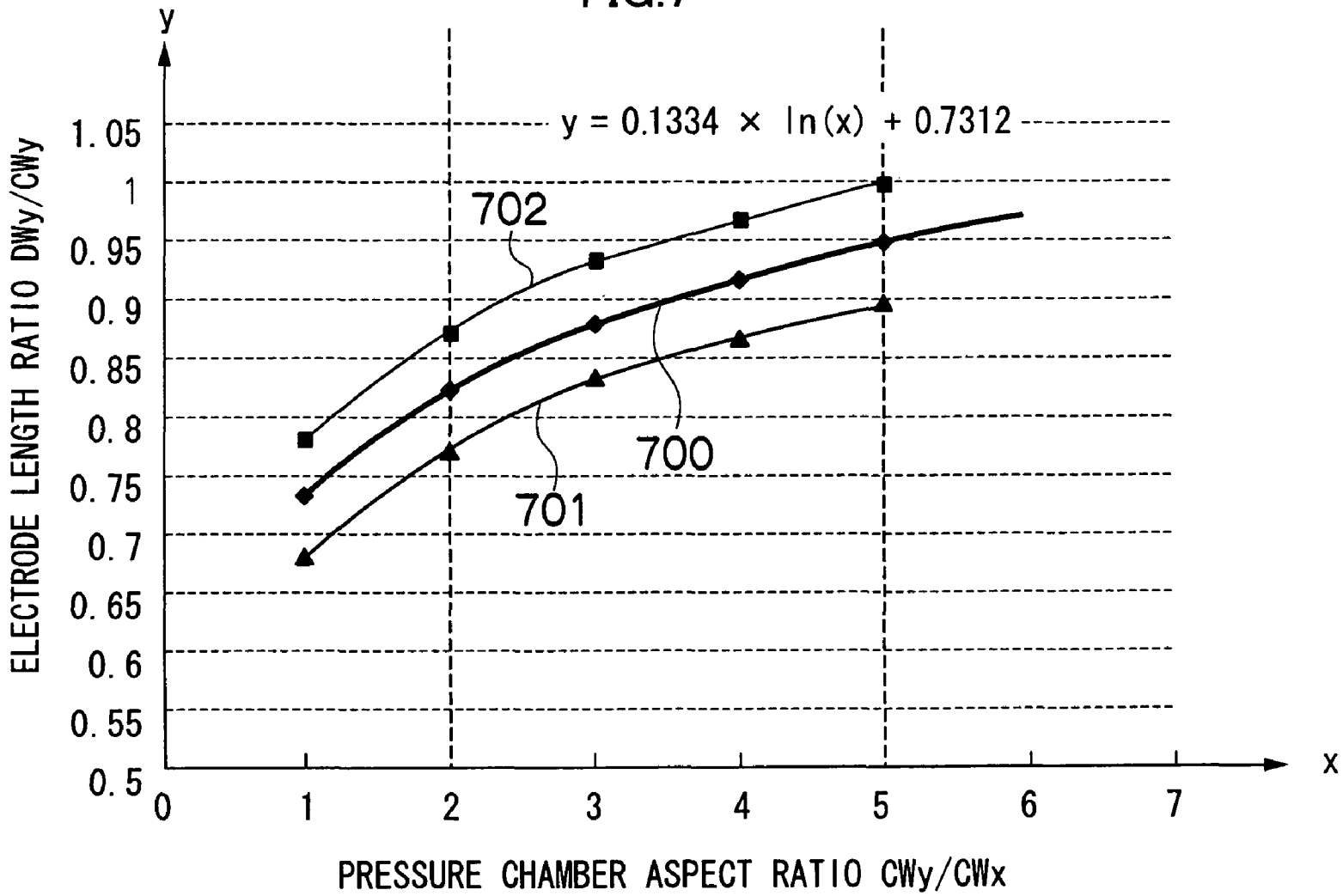
FIG. 7 is a diagram showing the relationship between the aspect ratio of the pressure chamber and the optimal electrode length ratio.

FIG. 7 shows the relationship between the aspect ratio CWy/CWx of the pressure chamber 52 and the optimal length DWy of the upper electrode 63.

In FIG. 7, the horizontal axis or the x axis represents the aspect ratio CWy/CWx of the pressure chamber 52, and the vertical axis or the y axis represents the electrode length ratio DWy/CWy of the upper electrode 63.

The central value curve 700 in FIG. 7 is obtained by determining and plotting the optimal values of DWy/CWy (corresponding to a point 610 in FIG. 6) respectively for the aspect ratios CWy/CWx (1, 2, 3, 4, and 5) of the pressure chamber 52. An approximate formula for the central value curve 700 thus obtained is determined as $y=0.1334\times\ln(x)+0.7312$, where ln(x) is the natural logarithm of the aspect ratio CWy/CWx of the pressure chamber 52, and y is the electrode length ratio DWy/CWy.

When one value of the aspect ratios CWy/CWx of the pressure chamber 52 (here, a value in the range of 2 through 5) is selected, then as shown in FIG. 6, even if the electrode breadth ratio DWx/CWx changes, the values of DWy/CWy at which the displacement volume ΔV becomes the maximum (i.e., the optimal values of DWy/CWy) are substantially uniform, and furthermore, the shapes of the curves of the displacement volume ΔV around the optimal values of DWy/CWy as the central values are also substantially uniform. Furthermore, when the optimal values of DWy/CWy are set within a range of −0.05 through +0.05 of the central value, then a large displacement volume is obtained, and since the maximum value is the central value, then the effects on the displacement volume of any size variations can be minimized. This relationship applies similarly even when the aspect ratio of the pressure chamber 52 is changed within the range of 2 through 5, and in FIG. 7, the allowable range is the region between a lower limit value curve 701, which is formed by shifting the central value curve 700 composed of the optimal values of DWy/CWy in the y direction by −0.05, and an upper limit value curve 702, which is formed by shifting the central value curve 700 in the y direction by +0.05.

In summary, the aspect ratio CWy/CWx of the pressure chamber 52 is set to any value in the range of 2 through 5, the electrode breadth ratio DWx/CWx, which corresponds to the ratio of the breadth of the active region 62*a* to the breadth of the pressure chamber 52, is set to any value in the range of 0.4 to 0.75, and the electrode length ratio DWy/CWy, which corresponds to the ratio of the length of the active region 62*a* to the length of the pressure chamber 52, is set to any value in the range of ±0.05 with respect to the central value of 0.1334×ln(x)+0.7312, where ln(x) is the natural logarithm of the aspect ratio CWy/CWx of the pressure chamber 52. By thus specifying the dimensions of the active region 62*a* with respect to the dimensions of the pressure chamber 52, even if the aspect ratio of the pressure chamber 52 is set to any desired value within the range of 2 through 5, it is still possible to obtain a large displacement volume in the vicinity of the maximum value of the displacement volume (which corresponds to the displacement volume ΔV in the maximum value 610 in FIG. 6). Moreover, since the variation in the displacement volume caused by manufacturing variation in the dimensions of the upper electrode 63 is extremely small, then there is extremely little ejection variation between the nozzles 51.

Figure 8:
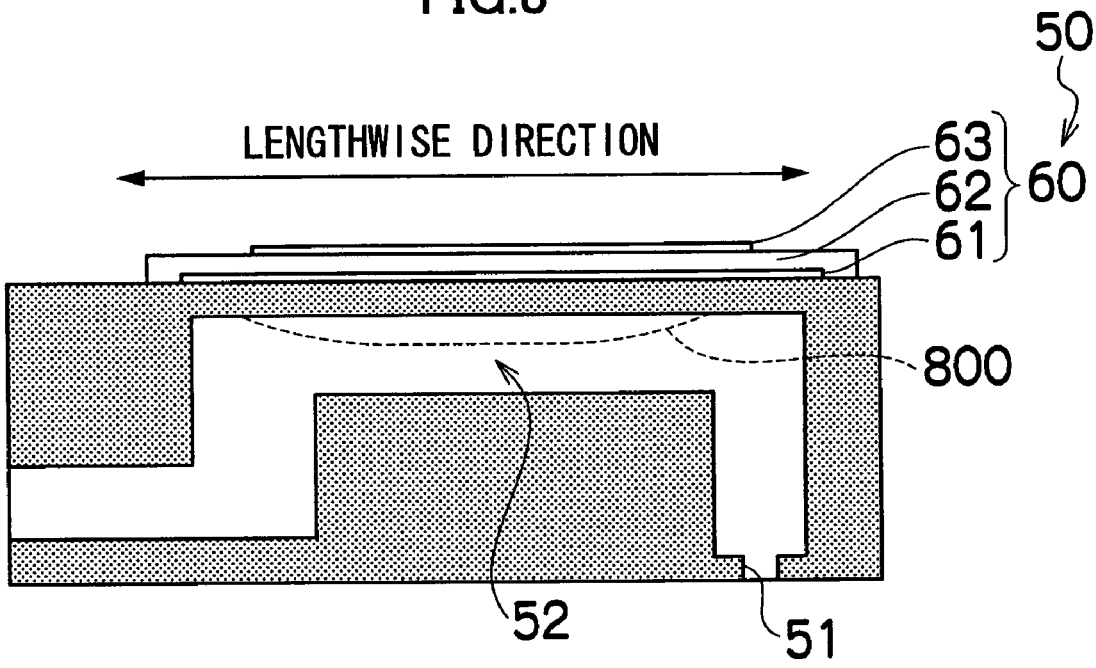
FIG. 8 is an illustrative diagram for describing prevention of the occurrence of bubbles.

Furthermore, the liquid ejection head 50 of the present embodiment is designed as: in the lengthwise direction of the pressure chamber 52, the width (length) of the active region 62*a* of the piezoelectric body 62 is smaller than the width (length) of the pressure chamber 52; and in the breadthways direction of the pressure chamber 52, the width (breadth) of the active region 62*a* of the piezoelectric body 62 is smaller than the width (breadth) of the pressure chamber 52. Hence, as shown in FIG. 8, a displacement profile 800 is a smooth and efficient displacement profile, high harmonic components are not liable to be generated inside the pressure chamber 52, bubbles are not liable to occur inside the pressure chamber 52, and there are no residual vibrations in the case of liquid ejection.

Figure 9A:
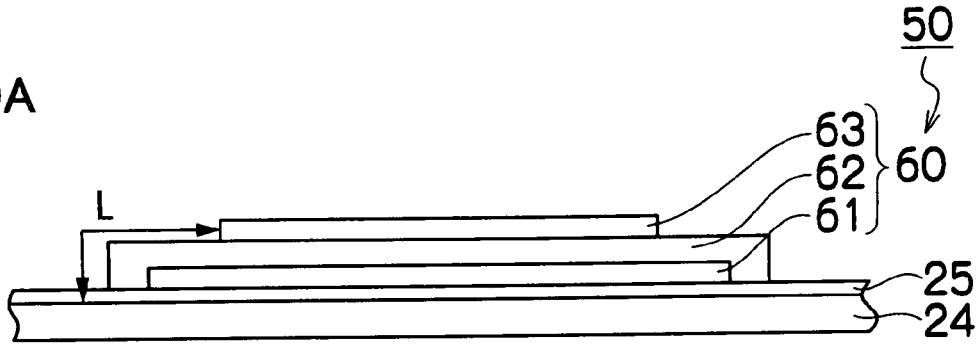
FIG. 9A is an illustrative diagram for describing the creepage distance in the liquid ejection head in FIGS. 2A and 2B.

FIG. 9A shows the creepage distance L along the surface of the piezoelectric body 62 from the edge of the upper electrode 63 in the liquid ejection head 50 shown in FIGS. 2A and 2B.

In FIG. 9A, since the lower electrode 61 is covered with the piezoelectric body 62 and the edge of the lower electrode 61 is shielded by the piezoelectric body 62, which is not conductive, then the creepage distance L is the distance from the edge of the upper electrode 63, along the surface of the piezoelectric body 62, until the diaphragm 24 (when the diaphragm 24 is made of a conductive material). The thickness of the insulating layer 25 is extremely small and then ignorable.

Figure 9B:
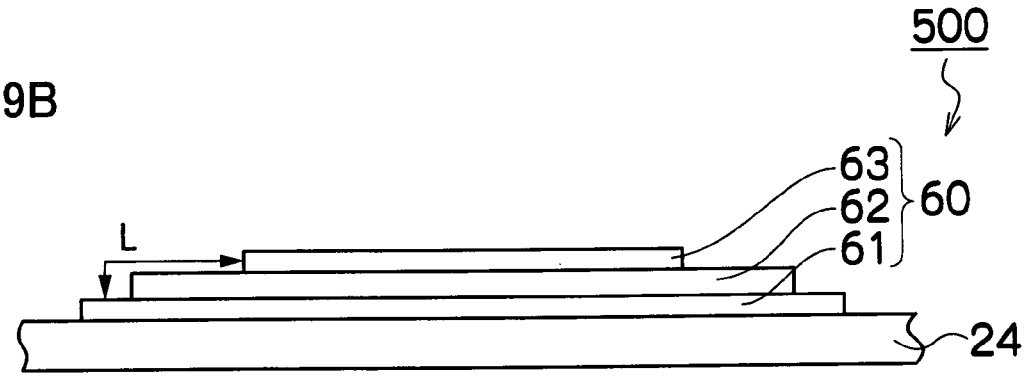
FIG. 9B is an illustrative diagram for describing the creepage distance in a liquid ejection head in another embodiment.

FIG. 9B shows the principal part of a liquid ejection head 500 according to another embodiment in which the lower electrode 61 is exposed. In FIG. 9B, the creepage distance L is the distance from the edge of the upper electrode 63, along the surface of the piezoelectric body 62, until the lower electrode 61.

In either of the cases in FIGS. 9A and 9B, the liquid ejection head 50 or 500 is composed in such a manner that the relationship between the shortest value of the creepage distance L (the minimum creepage distance) Lmin (micrometer (μm)) and the driving electric field E (volt (V)) of the piezoelectric body 62 satisfies E/Lmin≦1 (V/μm). Thereby, dielectric breakdown of the piezoelectric actuator 60 caused by creeping discharge is prevented, and the reliability of the liquid ejection head 50 or 500 can be improved further.

Each of the liquid ejection heads 50 and 500 according to the embodiments of the present invention is manufactured by successively forming the diaphragm 24, the insulating layer 25, the lower electrodes 61, the piezoelectric bodies 62, and the upper electrodes 63, over the pressure chambers 52, which connect to the nozzles 51.

In the manufacture of the liquid ejection head, the surface area of the active region 62*a* of the piezoelectric body 62, which region is between the lower electrode 61 and the upper electrode 63 and contributes to the displacement of the piezoelectric body 62, is formed to be smaller than the cross-sectional area of the recess part of the pressure chamber 52; the aspect ratio CWy/CWx between the length CWy of the pressure chamber 52 and the breadth CWx of the pressure chamber 52 is set to any value in the range of 2 through 5; the ratio DWx/CWx between the width DWx of the upper electrode 63 in the breadthways direction of the pressure chamber 52 (i.e., the breadth DWx of the upper electrode 63, which is equal to the breadth of the active region 62*a* of the piezoelectric body 62) and the breadth CWx of the pressure chamber 52 is set to any value in the range of 0.4 through 0.75; and the ratio DWy/CWy between the width DWy of the upper electrode 63 in the lengthwise direction of the pressure chamber 52 (i.e., the length DWy of the upper electrode 63, which is equal to the length of the active region 62*a* of the piezoelectric body 62) and the length CWy of the pressure chamber 52 is set to any value in the range of ±0.05 with respect to with respect to the central value of 0.1334×ln(x)+0.7312, where ln(x) is the natural logarithm of the aspect ratio CWy/CWx of the pressure chamber 52.

An embodiment of the manufacturing process of the liquid ejection head is described in detail.

FIGS. 10A to 10I are step diagrams showing the manufacturing process according to a first embodiment.

Figure 10A:
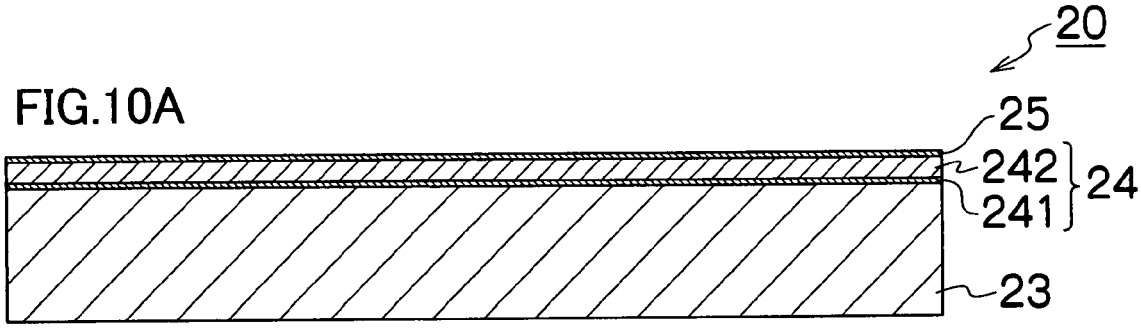
FIGS. 10A to 10I are step diagrams showing a manufacturing process according to a first embodiment.

Firstly, as shown in FIG. 10A, an SOI (silicon on insulator) substrate 20 having an insulating layer 25 on the surface thereof is prepared. The SOI substrate 20 is laminated from an Si layer 23, which serves as a pressure chamber plate, an $SiO_2$ layer 241 and an Si layer 242, which serve as a diaphragm 24), and an $SiO_2$ layer 25, which serves as an insulating layer.

Figure 10B:
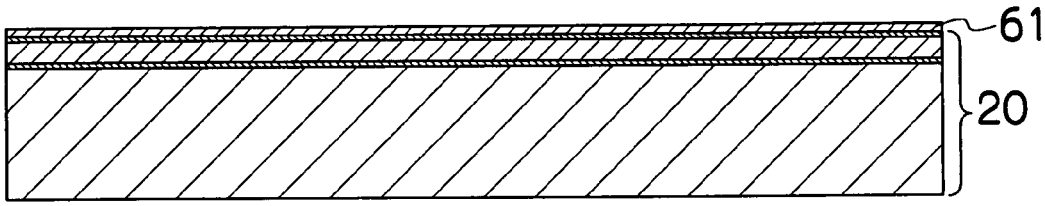

Then, as shown in FIG. 10B, a lower electrode 61 is deposited by sputtering onto the SOI substrate 20 shown in FIG. 10A. Of course, the deposition method is not limited to sputtering, and it is also possible to use CVD (chemical vapor deposition), vapor deposition, screen printing, or the like. The deposited material may be titanium, iridium, platinum, gold, copper, or laminates of these materials, or oxides of these materials.

Figure 10C:
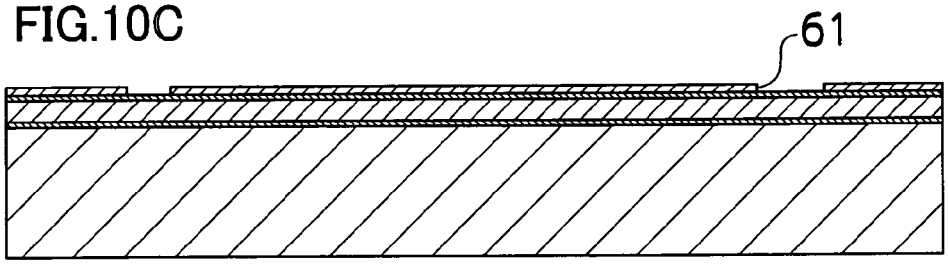

Thereupon, as shown in FIG. 10C, the lower electrode 61 is processed by etching. Here, RIE (reactive ion etching) is carried out using a fluorine or chlorine based gas with a trace of added argon. Of course, the etching method is not limited to RIE, and it is also possible to use wet etching, sandblasting or the like.

In the present embodiment, although an example is described in which the lower electrode 61 is processed, it is also possible to adopt a mode in which the processing of the lower electrode 61 is omitted and only the upper electrode is divided into individual electrodes.

Figure 10D:
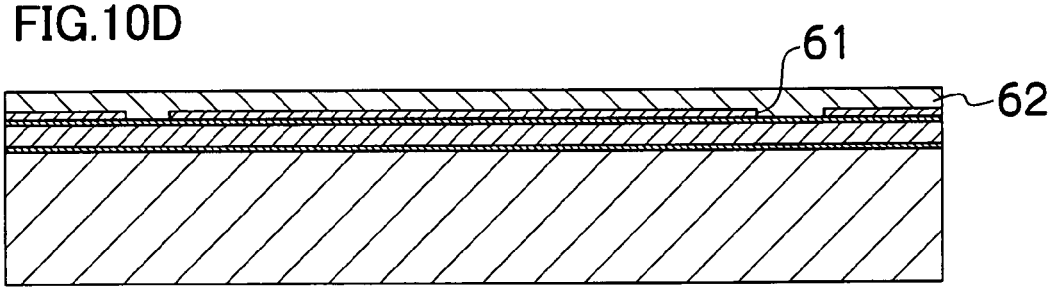

Thereupon, as shown in FIG. 10D, a piezoelectric body 62 (e.g., PZT) is deposited by sputtering as a thin film. The film deposition method is not limited to sputtering, and it is also possible to use aerosol deposition, sol-gel process, screen printing, metal organic chemical vapor deposition (MOCVD), laser ablation, hydrothermal synthesis, or the like.

Figure 10E:
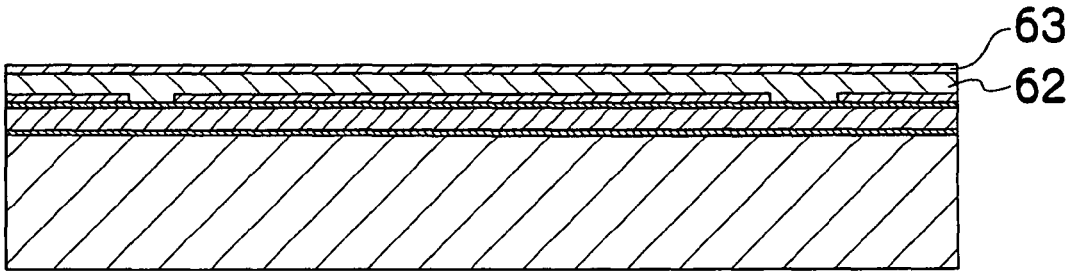

Thereupon, as shown in FIG. 10E, an upper electrode 63 is formed, by employing a similar method and material to those used in forming the lower electrode 61.

Figure 10F:
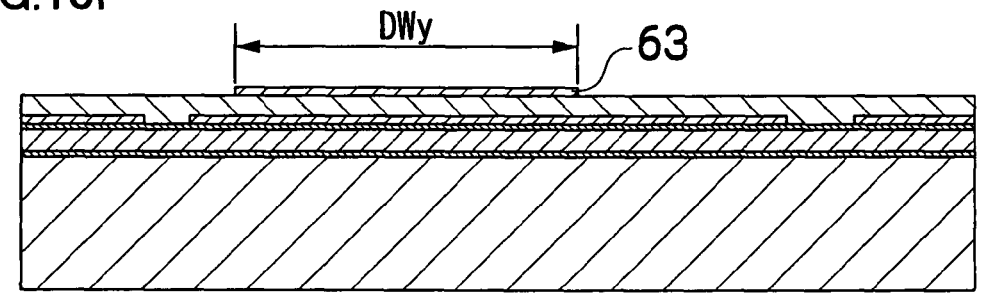

Thereupon, as shown in FIG. 10F, the upper electrode 63 is processed. Here, RIE is carried out using a fluorine or chlorine based gas with a trace of added argon. Of course, the etching method is not limited to RIE, and it is also possible to use wet etching, sandblasting or the like. The dimensions of the electrode, namely, the breadth DWx and the length DWy are set to prescribed ratio ranges with respect to the aspect ratio CWy/CWx of the pressure chamber which is processed subsequently. Here, the ratios DWx/CWx and DWy/CWy are set to prescribed ranges, as described above.

Figure 10G:
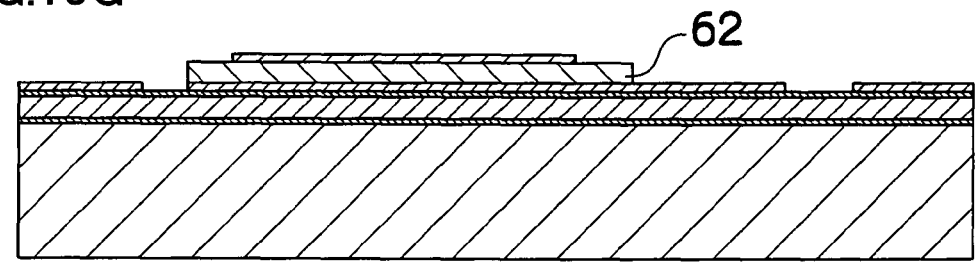

Thereupon, as shown in FIG. 10G, the piezoelectric body 62 is processed. This processing may employ dry etching using a fluorine or chlorine based gas with added argon, wet etching using an acid, or sandblasting.

Figure 10H:
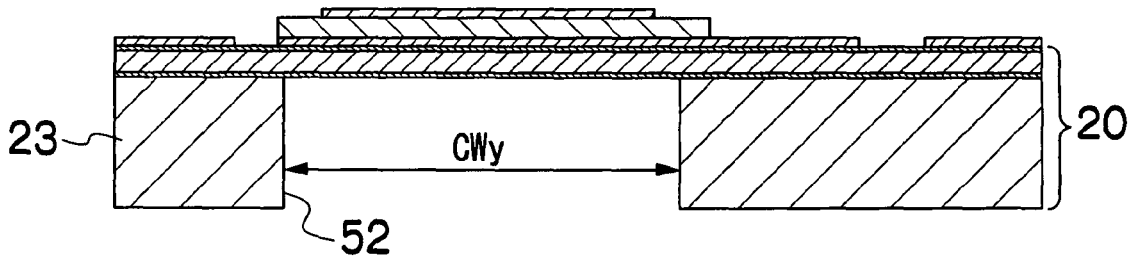

Thereupon, as shown in FIG. 10H, pressure chambers 52 are formed by etching in the Si layer 23, which corresponds to the pressure chamber plate, in the SOI substrate 20. RIE or anisotropic wet etching may be used for this process.

Figure 10I:
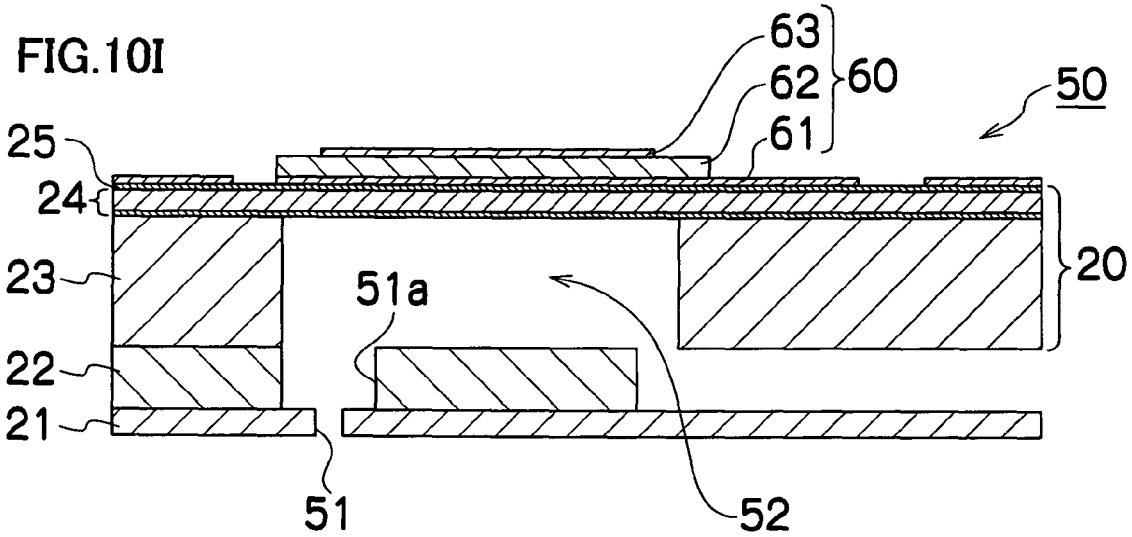

Finally, as shown in FIG. 10I, a nozzle plate 21 and a connection flow channel plate 22 are bonded or welded to the SOI substrate 20. Thus, the liquid ejection head 50 is obtained.

Here, although the embodiment is described in which the etching of the upper electrode 63 and the etching of the piezoelectric body 62 are carried out separately, it is also possible to etch the upper electrode 63 and the piezoelectric body 62 simultaneously.

FIGS. 11A to 11G are step diagrams showing a manufacturing processing according to a second embodiment.

Figure 11A:
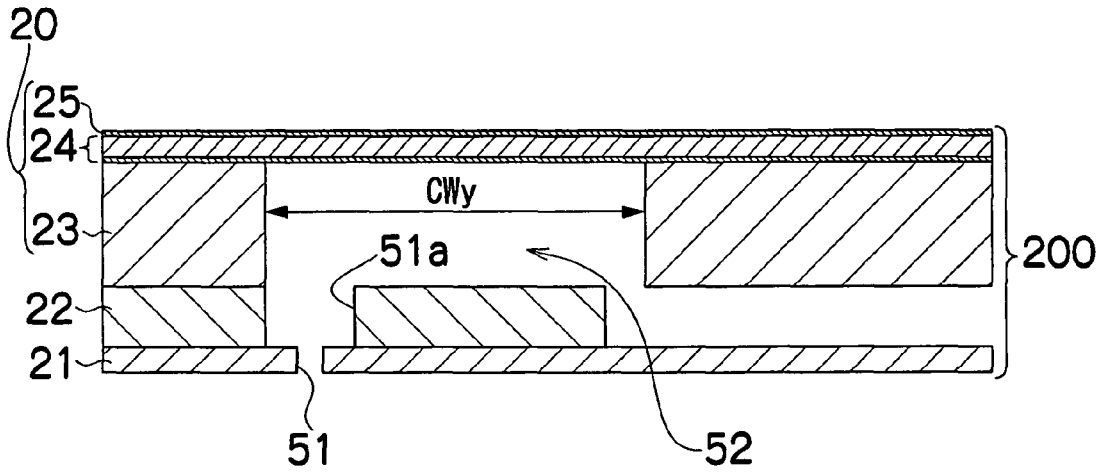
FIGS. 11A to 11G are step diagrams showing a manufacturing process according to a second embodiment.

Firstly, as shown in FIG. 11A, a substrate 200 having formed with openings is prepared. The substrate 200 is constituted of: a nozzle plate 21, in which nozzles 51 are formed; a connection flow channel plate 22, in which nozzle connection channels 51*a* are formed; a pressure chamber plate 23, in which pressure chambers 52 are formed; a diaphragm 24; and an insulating layer 25. The pressure chamber plate 23, the diaphragm 24 and the insulating layer 25 constitute the SOI substrate 20.

Figure 11B:
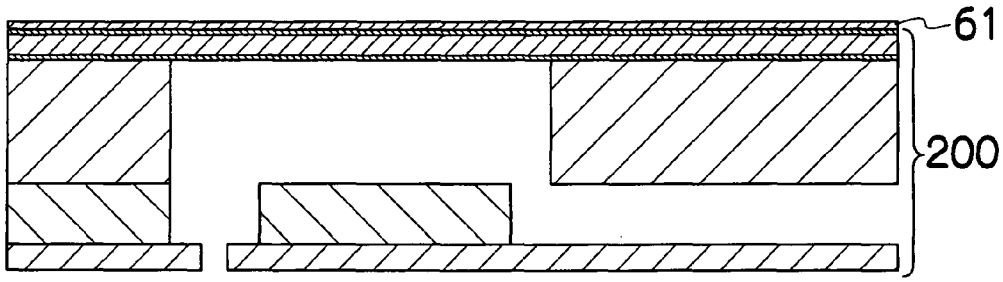

As shown in FIG. 11B, a lower electrode 61 is deposited by sputtering onto the substrate 200 shown in FIG. 11A. Of course, the deposition method is not limited to sputtering, and it is also possible to use CVD, vapor deposition, screen printing, or the like. The deposited material may be titanium, iridium, platinum, gold, copper, or laminates of these materials, or oxides of these materials.

Figure 11C:
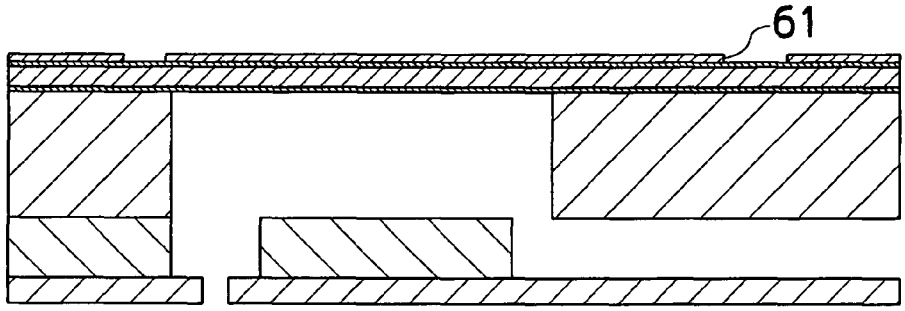

Then, as shown in FIG. 11C, the lower electrode 61 is processed by etching. Here, RIE is carried out using a fluorine or chlorine based gas with a trace of added argon. Of course, the etching method is not limited to RIE, and it is also possible to use wet etching, sandblasting or the like.

In the present embodiment, although an example is described in which the lower electrode 61 is processed, it is also possible to adopt a mode in which the processing of the lower electrode 61 is omitted and only the upper electrode is divided into individual electrodes.

Figure 11D:
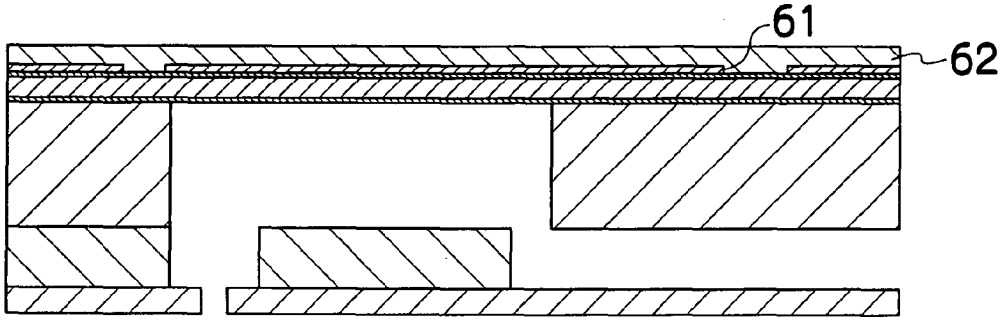

Thereupon, as shown in FIG. 11D, a piezoelectric body 62 (e.g., PZT) is deposited by sputtering as a thin film. The film deposition method is not limited to sputtering, and it is also possible to use aerosol deposition, sol-gel process, screen printing, MOCVD, laser ablation, hydrothermal synthesis, or the like.

Figure 11E:
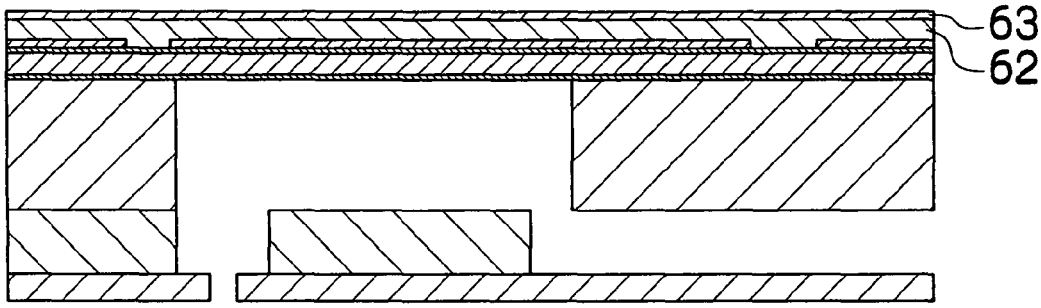

Thereupon, as shown in FIG. 11E, an upper electrode 63 is formed, by employing a similar method and material to those used in forming the lower electrode 61.

Figure 11F:
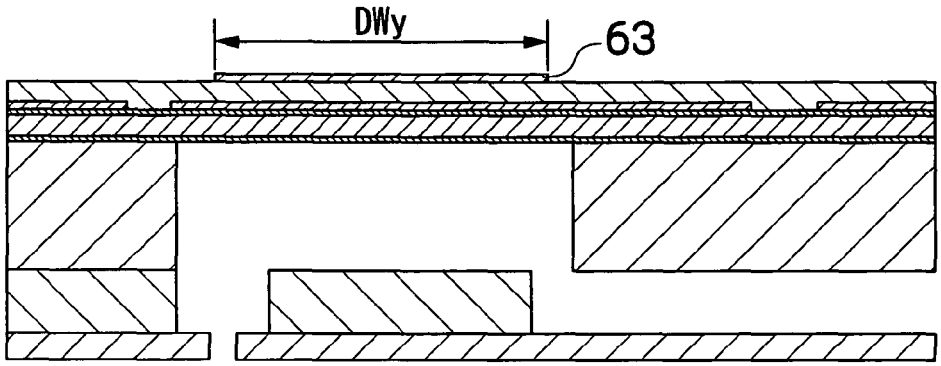

Thereupon, as shown in FIG. 11F, the upper electrode 63 is processed. Here, RIE is carried out using a fluorine or chlorine based gas with a trace of added argon. Of course, the etching method is not limited to RIE, and it is also possible to use wet etching, sandblasting or the like. The dimensions of the electrode, namely, the breadth DWx and the length DWy are set to prescribed ratio ranges with respect to the aspect ratio CWy/CWx of the pressure chamber 52, which has already been formed. Here, the ratios DWx/CWx and DWy/CWy are set to prescribed ranges, as described above.

Figure 11G:
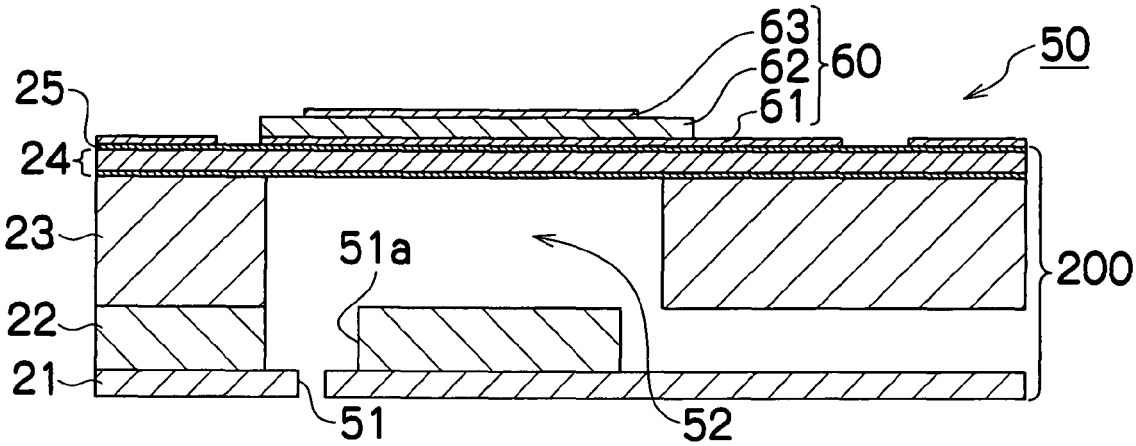

Thereupon, as shown in FIG. 11G, the piezoelectric body 62 is processed. This processing may employ dry etching using a fluorine or chlorine based gas with added argon, wet etching using an acid, or sandblasting. Thus, the liquid ejection head 50 is obtained.

Here, although the embodiment is described in which the etching of the upper electrode 63 and the etching of the piezoelectric body 62 are carried out separately, it is also possible to etch the upper electrode 63 and the piezoelectric body 62 simultaneously.

Figure 12A:
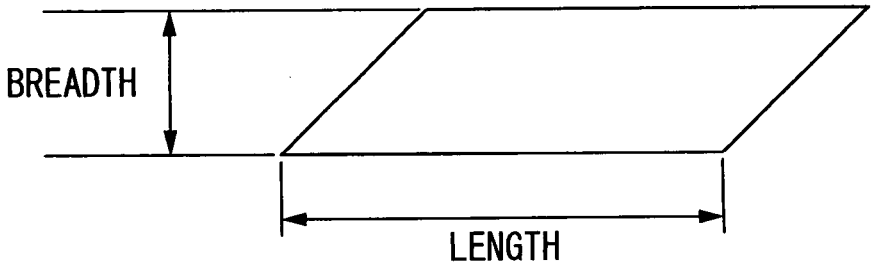
FIGS. 12A and 12B are illustrative diagrams for describing the breadth and the length of oblong shapes.
Figure 12B:
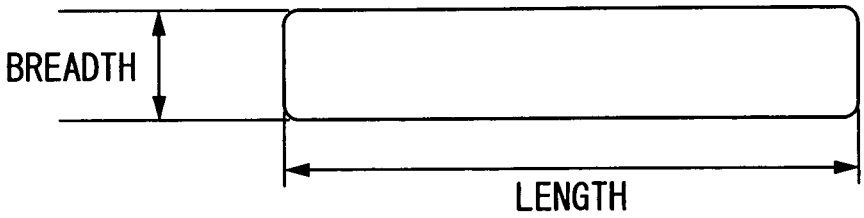

In the above-described embodiments of the liquid ejection head and the manufacturing method thereof, the cross-sectional shape of the recess part of the pressure chamber 52 (the cross-section in the planar direction of the piezoelectric body 62) is an oblong rectangular shape, but as shown in FIG. 12A, it is also possible that the cross-sectional shape of the recess part of the pressure chamber 52 is an oblong non-rectangular parallelogram shape. Moreover, it is also possible that the corners are rounded as shown in FIG. 12B. Even if the pressure chamber has a non-rectangular parallelogram shape and/or round corners, provided that the aspect ratio CWy/CWx is not less than 2, then there is no significant change in the displacement volume.

As regards the aspect ratio, in the case of an oblong rectangular shape (which includes a substantially rectangular shape having round corners), the width in the breadthways direction or the breadth means the dimension of the shorter sides of the rectangular, and the width in the lengthwise direction or the length means the dimension of the longer sides of the rectangular; and in the case of a non-rectangular parallelogram shape (which includes a substantially non-rectangular parallelogram shape having round corners), the width in the breadthways direction or the breadth means the shorter of the perpendicular distances between the pairs of opposite sides of the parallelogram (i.e., the shorter height of the parallelogram), and the width in the lengthwise direction or the length means the dimension of the longer sides of the parallelogram.

Image Forming Apparatus

Figure 13:
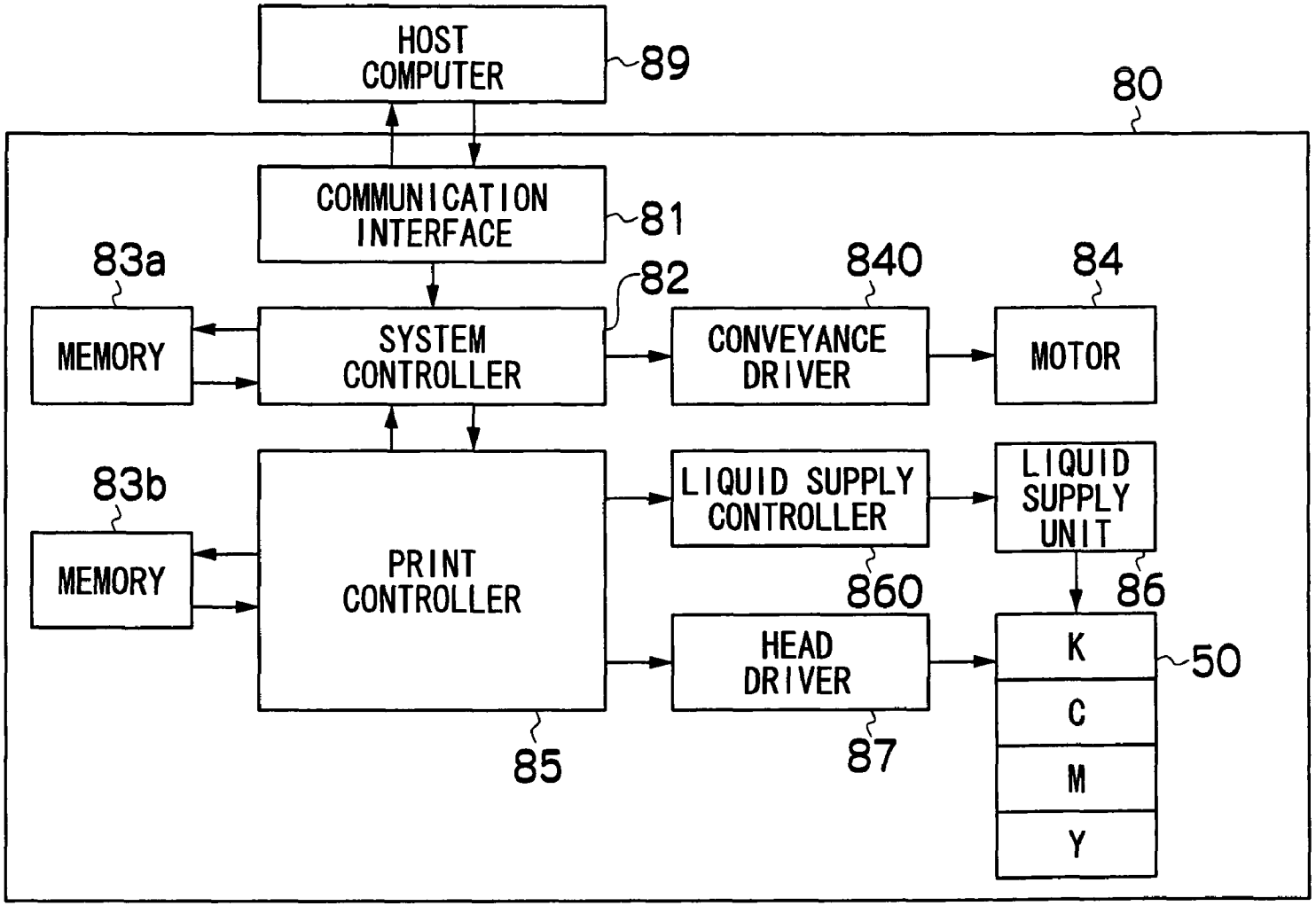
FIG. 13 is a block diagram showing the general composition of an image forming apparatus according to an embodiment of the present invention.
Figure 14:
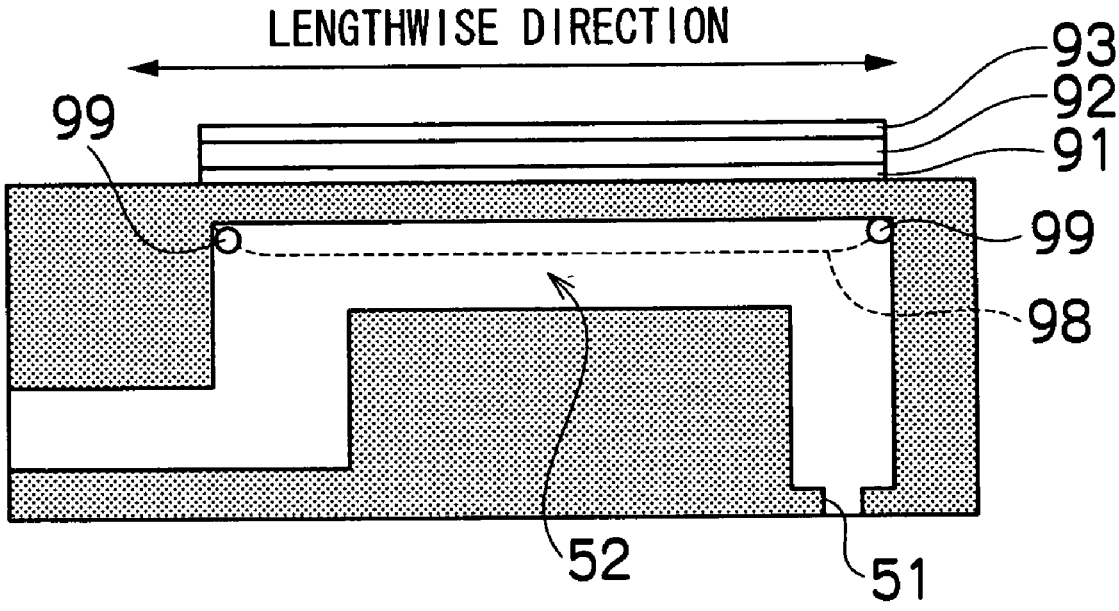
FIG.14 RELATED ART
FIG. 14 is an illustrative diagram for describing a liquid ejection head in the related art.

FIG. 13 is a block diagram showing an overview of an image forming apparatus 80 having the liquid ejection head 50 shown in FIG. 1.

In FIG. 13, the image forming apparatus 80 includes: the liquid ejection heads 50, a communication interface 81, a system controller 82, memories 83*a* and 83*b*, a conveyance motor 84, a conveyance driver 840, a print controller 85, a liquid supply unit 86, a liquid supply control unit 860 and a head driver 87.

The image forming apparatus 80 has a total of four liquid ejection heads 50, one for each color of black (K), cyan (C), magenta (M) and yellow (Y).

The communication interface 81 is an image data input device for receiving image data transmitted from a host computer 89. It is possible to use a wired or wireless interface for the communication interface 81. The image data acquired by the image forming apparatus 80 through the communication interface 81 is stored temporarily in the first memory 83*a*, which is used to store image data.

The system controller 82 is constituted of a central processing unit (CPU) and peripheral circuits thereof, and the like, and forms a main control device which controls the whole of the image forming apparatus 80 in accordance with a prescribed program. More specifically, the system controller 82 controls the respective units of the communication interface 81, the conveyance driver 840, the print controller 85, and the like.

The conveyance motor 84 supplies a motive force to rollers, belts, and the like, in order to convey the ejection receiving medium, such as paper. The ejection receiving medium and the liquid ejection heads 50 are moved relatively to each other, by means of the conveyance motor 84.

The conveyance driver 840 is a circuit which drives the conveyance motor 84 in accordance with commands from the system controller 82.

The liquid supply unit 86 is constituted of channels, pumps, and the like, which causes ink to flow from ink tanks (not shown) forming an ink storage device for storing ink, to the liquid ejection heads 50.

The liquid supply control unit 860 controls the supply of ink to the liquid ejection heads 50, by means of the liquid supply unit 86.

The print controller 85 generates the data (dot data) necessary for forming dots on the ejection receiving medium by ejecting and depositing liquid droplets from the liquid ejection heads 50 onto the ejection receiving medium, on the basis of the image data inputted to the image forming apparatus 80. More specifically, the print controller 85 is a control unit which functions as an image processing device that carries out various image treatment processes, corrections, and the like, in accordance with the control implemented by the system controller 82, in order to generate dot data for controlling droplet ejection, from the image data inside the first memory 83*a*, and it supplies the dot data thus generated to the head driver 87.

The print controller 85 is provided with the second memory 83*b*, and dot data and the like are temporarily stored in the second memory 83*b* when image is processed in the print controller 85.

The aspect shown in FIG. 13 is one in which the second memory 83*b* accompanies the print controller 85; however, the first memory 83*a* may also serve as the second memory 83*b*. Also possible is an aspect in which the print controller 85 and the system controller 82 are integrated to form a single processor.

The head driver 87 outputs ejection drive signals to the piezoelectric actuators 60 of the liquid ejection heads 50 on the basis of the dot data supplied by the print controller 85 (in practice, the dot data stored in the second memory 83*b*). By applying the ejection drive signals outputted from the head driver 87 to the piezoelectric actuators 60 of the liquid ejection heads 50, liquid (droplets) are ejected from the nozzles 51 of the liquid ejection heads 50 toward the ejection receiving medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a liquid ejection port;

a pressure chamber which has a recess part connected to the liquid ejection port;

a lower electrode which is arranged on the pressure chamber;

a piezoelectric body which has a planar face arranged on the lower electrode; and an upper electrode which is arranged on the piezoelectric body, wherein:

a cross section of the recess part of the pressure chamber taken in parallel to the planar face of the piezoelectric body is oblong and has a breadth CWx in a breadthways direction and a length CWy in a lengthwise direction;

the piezoelectric body has an active region positioned between the lower and upper electrodes and contributing to displacement of the piezoelectric body, an area of the active region being smaller than an area of the cross section of the recess part of the pressure chamber, the active region having a breadth DWx in the breadthways direction of the cross section of the recess part of the pressure chamber and a length DWy in the lengthwise direction of the cross section of the recess part of the pressure chamber;

a ratio CWy/CWx is in a range of 2 through 5;

a ratio DWx/CWx is in a range of 0.4 through 0.75; and a ratio DWy/CWy is in a range of ±0.05 of a central value of $0.133 \times \ln(CWy/CWx) + 0.7312$, where $\ln(CWy/CWx)$ is a natural logarithm of the ratio CWy/CWx.

2. The liquid ejection head as defined in claim 1, wherein:

the piezoelectric body has a single sheet structure; and a relationship between a minimum creepage distance Lmin along a surface of the piezoelectric body from an edge of the upper electrode, and a drive electric field E of the piezoelectric body, satisfies $E/Lmin \leqq 1$ (V/μm).

3. An image forming apparatus comprising the liquid ejection head as defined in claim 1.

4. A method of manufacturing a liquid ejection head comprising a liquid ejection port, a pressure chamber which has a recess part connected to the liquid ejection port, a lower electrode which is arranged on the pressure chamber, a piezoelectric body which has a planar face arranged on the lower electrode, and an upper electrode which is arranged on the piezoelectric body, the method comprising:

forming the recess part of the pressure chamber to have a cross section taken in parallel to the planar face of the piezoelectric body which cross section is oblong and has a breadth CWx in a breadthways direction and a length CWy in a lengthwise direction; and forming the piezoelectric body to have an active region positioned between the lower and upper electrodes and contributing to displacement of the piezoelectric body so that an area of the active region is smaller than an area of the cross section of the recess part of the pressure chamber, the active region has a breadth DWx in the breadthways direction of the cross section of the recess part of the pressure chamber and a length DWy in the lengthwise direction of the cross section of the recess part of the pressure chamber, a ratio CWy/CWx is in a range of 2 through 5, a ratio DWx/CWx is in a range of 0.4 through 0.75, and a ratio DWy/CWy is in a range of ±0.05 of a central value of 0.133×ln(CWy/CWx)+0.7312, where ln(CWy/CWx) is a natural logarithm of the ratio CWy/CWx.

5. The method as defined in claim 4, wherein the piezoelectric body forming step includes forming the piezoelectric body in a thin film by performing at least one of sputtering, aerosol deposition, sol-gel process, screen printing, metal oxide chemical vapor deposition, laser ablation, and hydrothermal synthesis.

* * * * *